US007714243B2

(12) United States Patent
Birdwell

(10) Patent No.: US 7,714,243 B2
(45) Date of Patent: May 11, 2010

(54) PUSH BUTTON DOORBELL SWITCH APPARATUS

(75) Inventor: Timothy Gale Birdwell, Lafayette, TN (US)

(73) Assignee: Heathco, LLC, Elmhurst, IL (US)

( * ) Notice: Subject to any disclaimer, the term of this patent is extended or adjusted under 35 U.S.C. 154(b) by 654 days.

(21) Appl. No.: 11/555,788

(22) Filed: Nov. 2, 2006

(65) Prior Publication Data

US 2008/0105523 A1 May 8, 2008

(51) Int. Cl.
*H01H 13/14* (2006.01)

(52) U.S. Cl. ..... 200/341; 200/296; 361/600; 174/54

(58) Field of Classification Search ..... 200/341, 200/293, 296; 361/600, 627, 632, 673; 174/48, 174/49, 54–56
See application file for complete search history.

(56) References Cited

U.S. PATENT DOCUMENTS 3,084,962 A * 4/1963 Feuerbacher ..... 248/27.3
4,840,584 A * 6/1989 Cox ..... 439/538
6,590,176 B2 * 7/2003 Cole et al. ..... 200/341
6,828,519 B2 * 12/2004 Bui et al. ..... 200/341
7,180,021 B2 2/2007 Birdwell et al.
2003/0094358 A1 * 5/2003 Bui et al. ..... 200/341
2003/0169178 A1 * 9/2003 Jensen et al. ..... 340/815.5

* cited by examiner

*Primary Examiner*—Kyung Lee
(74) *Attorney, Agent, or Firm*—Fitch Even Tabin & Flannery

(57) ABSTRACT

The push button doorbell switch is used interchangeably within the decorative plates of a doorbell button assembly. Each insert of the push button doorbell switch is capable of being interchanged in a congruent aperture of a variety of decorative plates. These doorbell switch assemblies allow for the user to interchange a plurality of button shapes without having to repurchase and install a new decorative plate. The plurality of doorbell button shapes, associated with the interchangeable doorbell button switch, can increase the variety of push button doorbell switch assemblies that can be created and installed as house décor.

23 Claims, 7 Drawing Sheets

PUSH BUTTON DOORBELL SWITCH APPARATUS

TECHNICAL FIELD

The present invention relates to a push button doorbell and particularly to an interchangeable push button switch apparatus.

DETAILED DESCRIPTION

Figure 1:
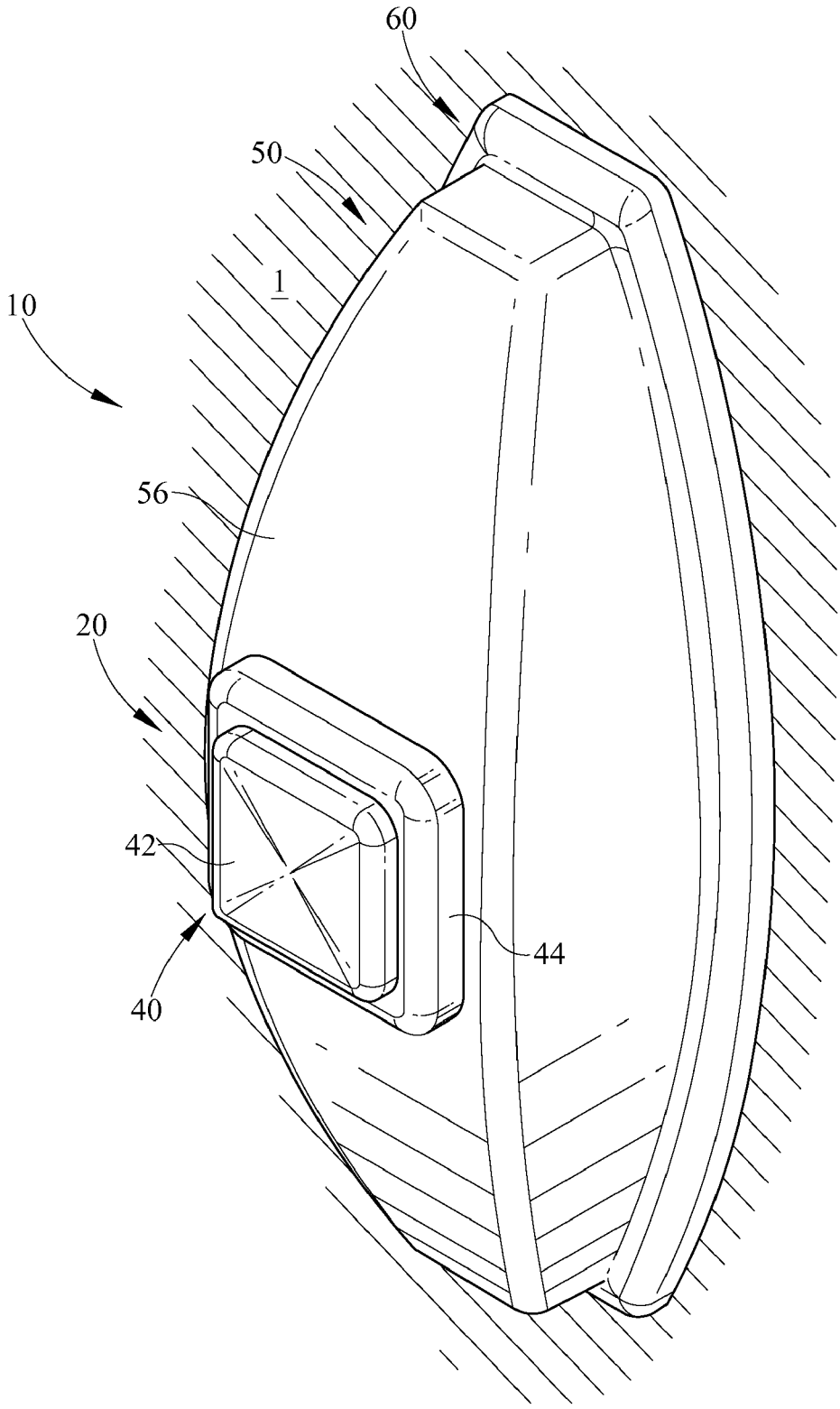
FIG. 1 is a top perspective view of an assembled doorbell switch assembly.
Figure 2:
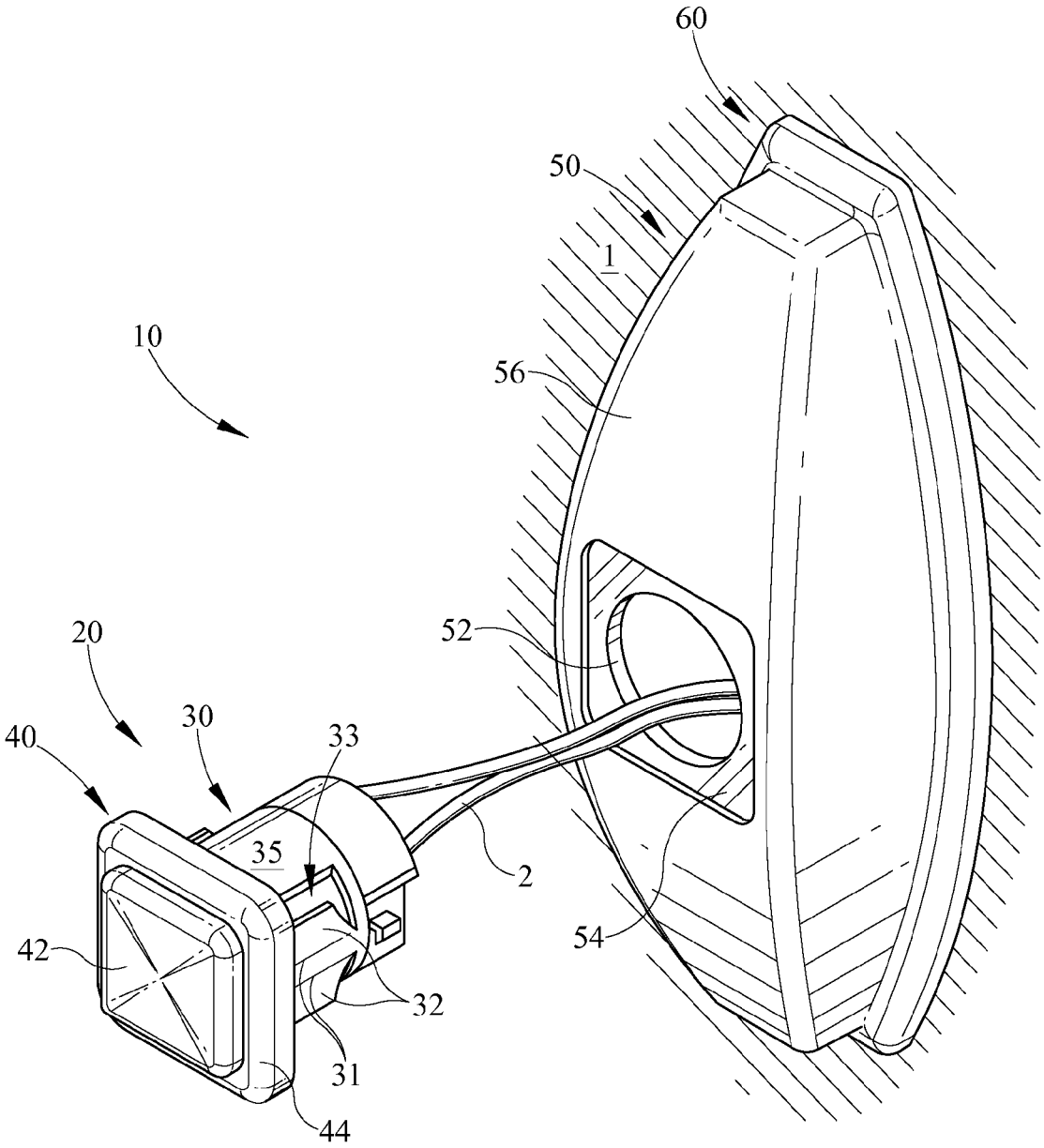
FIG. 2 is a top perspective view of the doorbell switch assembly of FIG. 1 with the push button switch exploded away from the decorative plate.

The doorbell switch assembly 10 depicted in FIGS. 1 and 2 of the drawings provides a push button doorbell switch 20 capable of being interchanged with other desirable push button shapes. An insert portion 30 of a push button switch 20 coincides with the dimensions and/or shapes of an aperture 52 of a decorative plate 50 allowing for interchangeability of a variety of push button switch apparatuses having insert 30. The interchangeability of the push button switches allows for the user to interchange the push button doorbell switch 20 without having to purchase and install a new decorative plate. A plurality of varying doorbell button shapes can be used in a single decorative plate thereby increasing the variety of doorbell switch assemblies a user can choose from in selecting, changing, or upgrading the house décor.

Exterior doors of homes and other dwellings are commonly equipped with doorbell switch assembly 10 by which a visitor may announce him or herself to those inside the dwelling. As illustrated in FIGS. 1 and 2 the doorbell switch assembly 10 may include push button switch 20, decorative plate 50, and a mounting base 60. Decorative plate 50 may be releaseably mounted to base 60 of the doorbell assembly, or may otherwise be attached directly to an exterior wall 1 of the dwelling (not shown). The doorbell switch is operably connected, either by electrical wiring 2 (FIGS. 2, 3) or a wireless link, to an interior signaling device (not shown) such as an electromechanical ringer or electronic tone generator mounted inside the dwelling. The interior signaling device is actuated when an exterior doorbell push button 42 is pressed by a visitor or user. All or portions of decorative plate 50, base 60, and push button switch 20 may be made of any metal including decorative material such as brass, bronze, aluminum, zinc, stainless steel, chrome, porcelain, plated steel, plastic, or any other material known to those skilled in the art.

However, doorbell switch assembly 10 may be made from, or in part, of plastic or other suitable materials or in combination with other metal as described above.

Figure 3:
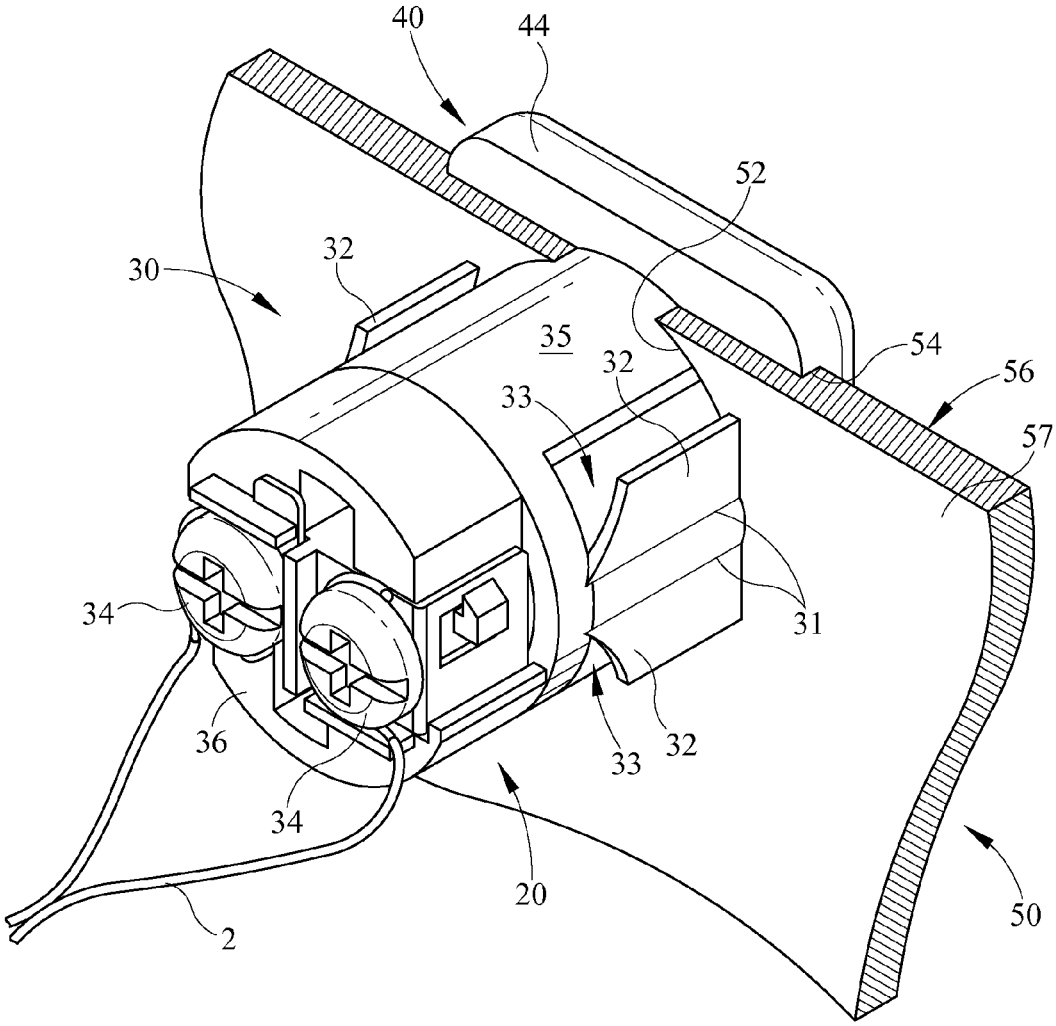
FIG. 3 is a rear, top perspective view of the doorbell switch assembly of FIG. 1 wherein portions of the decorative plate are partially broken away.
Figure 4:
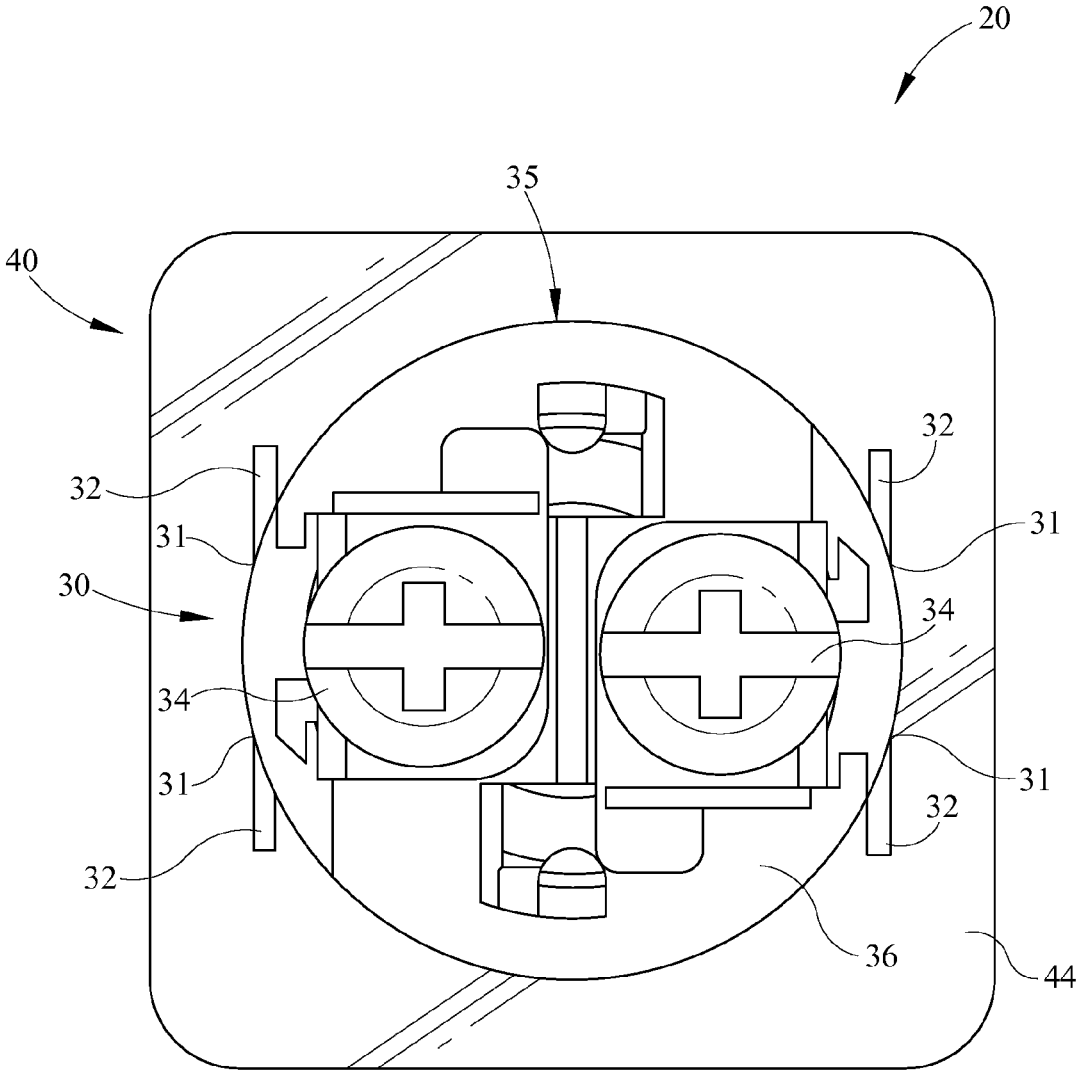
FIG. 4 is a rear view of the push button switch of FIG. 3.

As illustrated in FIGS. 2, 3, and 4, push button switch 20 includes an outer portion 40 and an insert or inner portion 30. Outer portion 40 includes a push button or pad 42 which is substantially square in shape. Many other push button 42 shapes can be used in connection with the invention and still be within the scope thereof. For example, rectangular, polygon, round, or non-round shapes (FIG. 7) may be employed as push button shapes. Outer portion 40 also comprises a flange 44 disposed around the perimeter of push button 42. Insert 30 contains a plurality of outward projecting tabs 32 that are used in conjunction with flange 44 to maintain a fixed axial position of the push button switch 20 in relation to decorative plate 50 (FIG. 3). As shown in FIGS. 2 and 3, insert 30 is dimensioned and/or shaped to be received into an aperture 52 of decorative plate 50. Insert 30 is substantially cylindrical in shape and congruent with the substantially cylindrical shape of aperture 52. It should be understood that insert 30 may be a variety of different shapes and sizes and still be dimensioned to be received in a variety of corresponding shapes and sizes of aperture 52.

During insertion of insert 30 into aperture 52 of decorative plate 50, tabs 32 are forcibly retracted by the force of insertion (unless already in retracted position) into corresponding recess 33 to allow the tabs to pass thru aperture 52 while push button switch 20 is axially inserted into aperture 52. Once tabs 32 pass through aperture 52, the tabs may naturally return to their projecting configuration or may be manually forced outward to the projecting configuration. Tabs 32 are able to flex about a central pivot point 31 to travel from the closed or retracted configuration to an open or projecting configuration. The closed or retracted position of tabs 32 facilitates tabs 32 to be received within aperture 52. The open or projecting position of tabs 32 facilitates tabs 32 to project radially from an exterior surface 35 of insert 30 to engage plate 50. Once insert 30 is inserted and the tabs 32 are radially extended, plate 50 surrounding aperture 52 becomes compressed between the plurality of tabs 32 and flange 44 which substantially minimizes the axial and/or rotational movement of push button switch 20 relative to decorative plate 50. Flange 44 makes contact with an exterior surface 56 of plate 50 while the plurality of tabs 32 engages an interior surface 57 of plate 50.

As illustrated in FIGS. 3 and 4, electrical contacts 34, shown as conventional screw contacts, may be positioned on an end 36 of insert 30. In other embodiments, electrical contacts 34 may include, but are not limited to, wire sockets, wire clips, terminal blocks and the like. Electrical contacts 34 may be operably connected to the interior signaling device by electrically conductive wire 2 or wireless link. Push button switch 20 is normally electrically open. When the user manually depresses push button 42, the switch is actuated and closes the open circuit and completes the electrical circuit between an electrical power source (not shown) and the interior signaling device (not shown) resulting in a signal, typically an audible sound. A user may pass electrical wire 2 through aperture 52 from within decorative plate 50 and subsequently affix to electrical contacts 34 before insertion of insert 30 into aperture 52.

Figure 6:
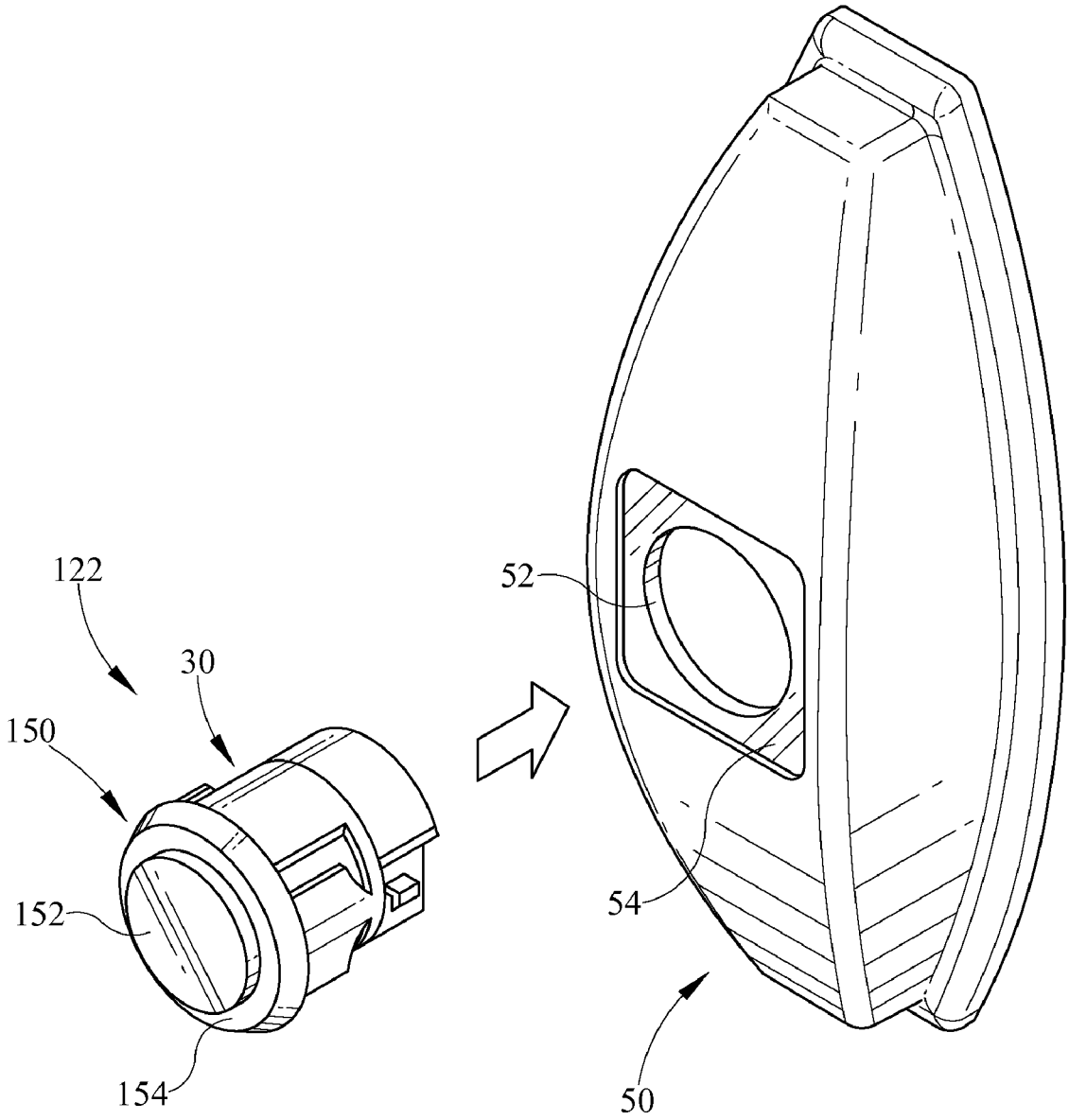
FIG. 6 is a top perspective view of an embodiment of the doorbell switch assembly illustrating a round push button doorbell switch with a round flange exploded away from the decorative plate.

As shown in FIGS. 2 and 3, decorative plate 50 has aperture 52 in which doorbell switch 20 is received. Decorative plate 50 may have a recess 54 in an exterior surface 56 which coincides with the shape of flange 44 of the push button switch 20. Recess 54 operates to minimize rotational movement of switch 20. Flange 44 and recess 54 may be substantially identical in shape, however the recess does not necessarily have to coincide in shape to be within the scope of the invention, as shown in FIG. 6. Also, recess 54 may not be included in exterior surface 56 of decorative plate 50 and still allow switch 20 to functionally interchange between a variety of decorative plates.

Figure 7:
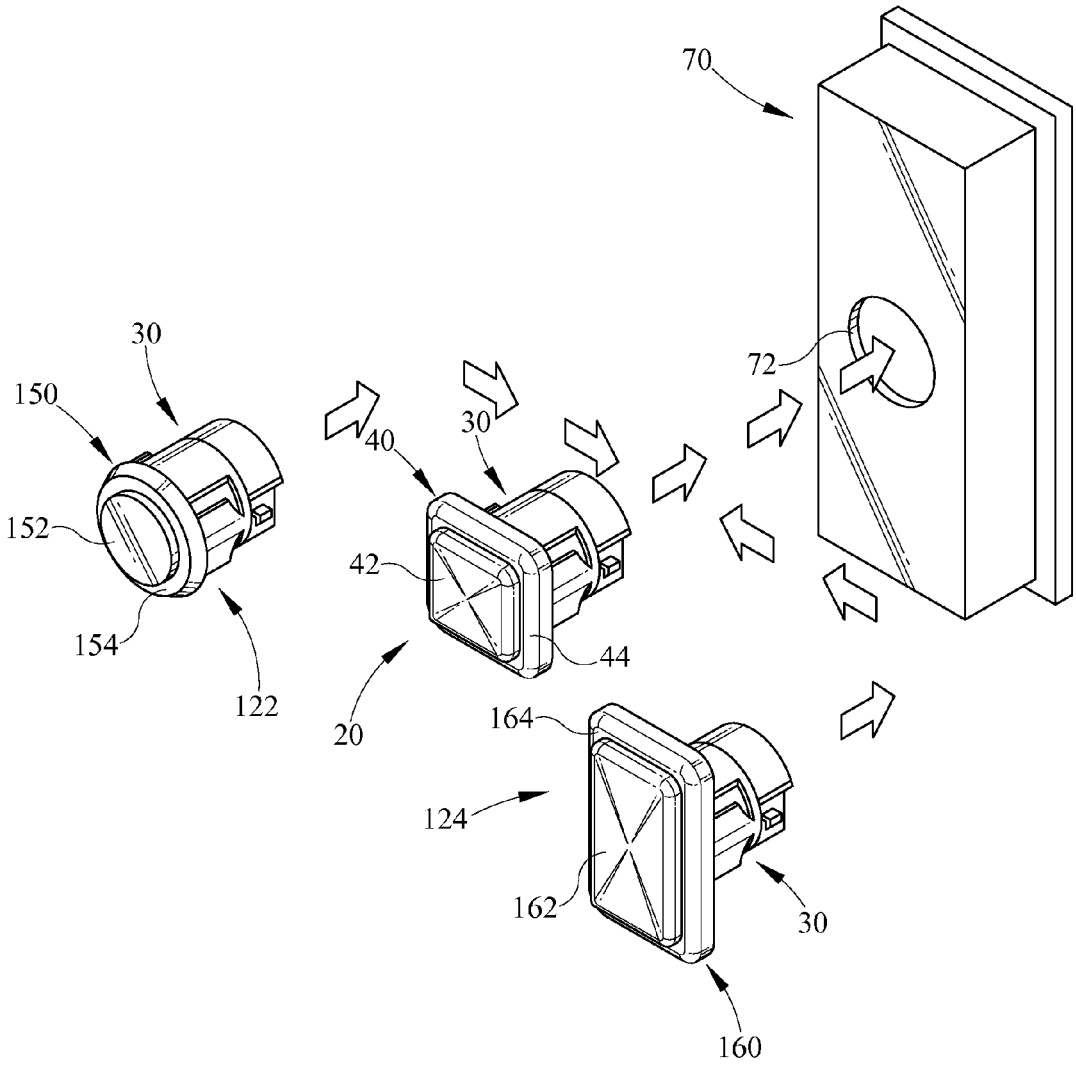
FIG. 7 is a top perspective view of a series of interchangeable doorbell switch assemblies exploded away from a decorative plate having an unrecessed aperture.

Decorative plate 50 may be any number of different shapes and sizes and still be within the interchangeable design of push button switch 20. As shown in FIGS. 1, 2, 5, and 6, decorative plate 50 may have exterior surface 56 that is substantially curved to enclose a portion of insert 30. As shown in FIG. 7, in another embodiment of the invention a decorative plate 70 is substantially flat and is without a recess surrounding an aperture 72.

Also, the mechanism for minimizing the rotational and/or axial movement of switch 20 need not be in the form of tabs 32. There are many mechanisms known in the art that may be used to inhibit axial or rotational movement that are within the scope of the instant invention.

Base 60 may be attached to wall 1 or any exterior surface by any means known in the art, such as nails or screws. Again, decorative plate 50 may be releaseably mounted to base 60 of the doorbell assembly 10, or may otherwise be attached directly to exterior wall 1 of the dwelling (not shown). If decorative plate 50 is attached directly to a surface the plate is affixed thereto by screws or other conventional fasteners. When plate 50 is attached to base 60, it may either be snapped or clipped into base 60, or secured by any other fastening means known in the art. By mounting plate 50 to base 60, the plate may be attached to the wall so as to minimize visible screw heads or the like, thus creating a surface uninterrupted by visible fastening means.

Figure 5:
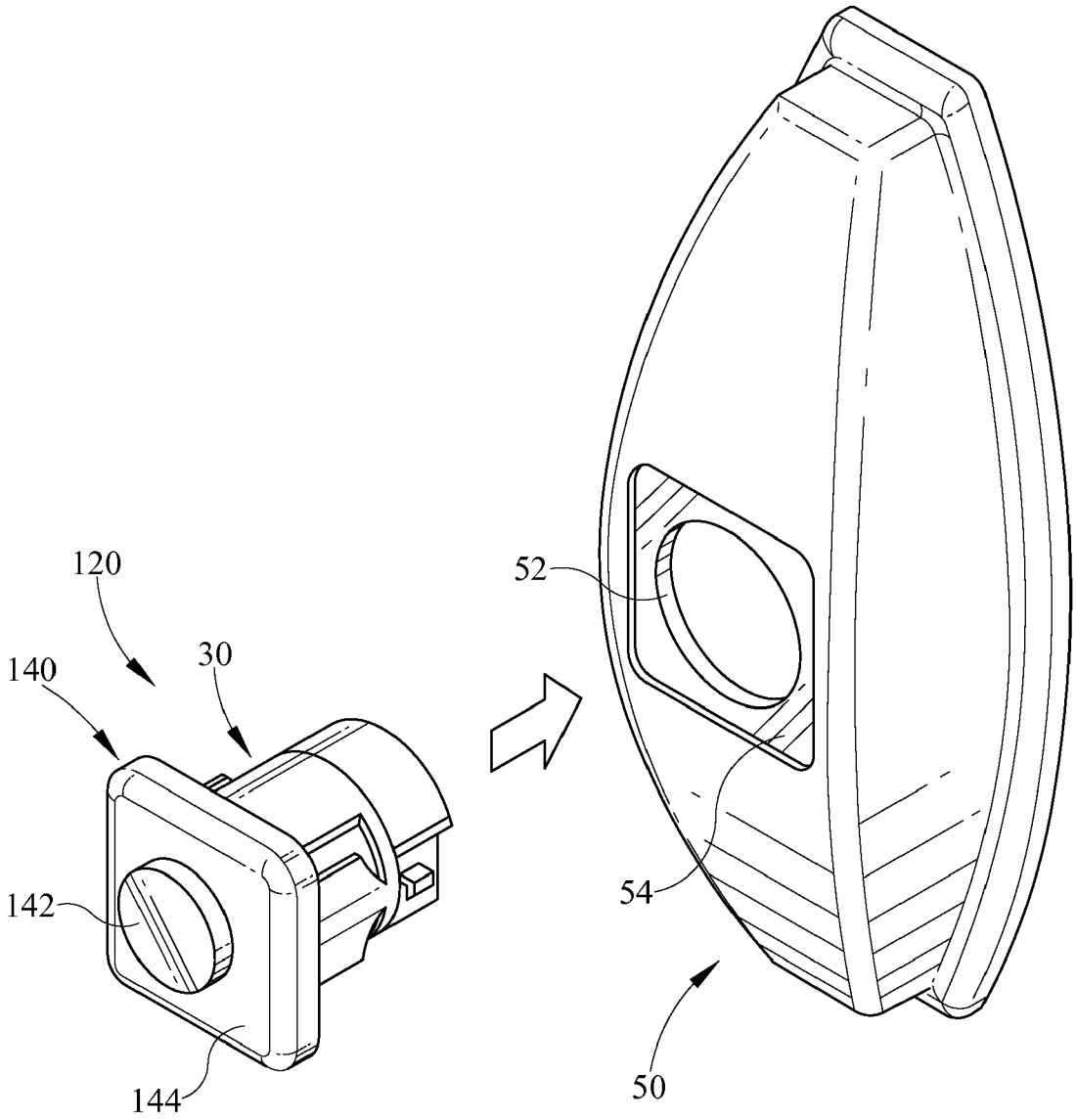
FIG. 5 is a top perspective view of an embodiment of the doorbell switch assembly illustrating a round push button doorbell switch with a square flange exploded away from the decorative plate.

Numerous shapes and sizes of push button pad 42 can be used in conjunction with push button switch 20, providing aperture 52 and insert 30 remain congruent in shape for interchangeability. As illustrated in FIG. 5 in an alternate embodiment of the invention, decorative plate 50 can be assembled with a round button switch 120 with a square flange 144 of an outer portion 140 surrounding a round button 142. In another embodiment of the invention as illustrated in FIG. 6, a round button switch 122 has a round flange 154 of an outer portion 150 surrounding a round button 152. Even though outer portion 150 of round button switch 122 does not coincide in shape with recess 54, the present invention permits switch 122 to be interchanged with another switch apparatus.

As illustrated in FIG. 7, multiple push button switches can be used with a decorative plate 70 having no recess. Push button switch 20 may be received within unrecessed decorative plate 70. Additionally, push button switch 122 having a substantially round push button pad 152 and flange 154 may be received within unrecessed decorative plate 70. Furthermore, a push button switch 124 having a substantially rectangular pad 162 and a flange 164 of an outer portion 160 may be received within unrecessed decorative plate 70. The switches 20, 122, 124 can be used in a single decorative plate 70 because of the congruent shapes of insert 30 and aperture 72 of decorative plate 70. As a result, a user can choose from a variety of doorbell push button shapes increasing the variety of doorbell switches a user can choose from in selecting, changing, or upgrading their house decor.

It is understood that while certain embodiments of the invention have been illustrated and described, it is not limited thereto except insofar as such limitations are included in the following claims and allowable functional equivalents thereof.

I claim:

1. A push button switch assembly for a doorbell comprising:

a push button switch having a first end and a second end, said first end having a push button pad surrounded by a flange, wherein said push button pad is not round in shape, said second end having a pair of electrical contacts, and said second end of said push button switch having an exterior surface;

a decorative plate having an exterior surface and an interior surface, an aperture therein from said exterior surface to said interior surface, said aperture being dimensioned to receive said second end of said push button switch therethrough, wherein said flange of said first end of said push button switch is adjacent to said exterior surface of said plate with the push button switch installed in the decorative plate; and wherein said exterior surface of said second end of said push button switch has at least one mechanism to minimize rotational motion of the switch pad with respect to the decorative plate.

2. The push button switch assembly as in claim 1 wherein said push button pad is substantially square in shape.

3. The push button switch assembly as in claim 1 wherein said push button pad is substantially rectangular in shape.

4. The push button switch assembly as in claim 1 wherein each said electrical contact is a screw contact.

5. The push button switch assembly as in claim 1 wherein said exterior surface of said plate comprises a recess shaped to receive said flange.

6. The push button switch assembly as in claim 1 wherein said second end is substantially cylindrical in shape.

7. The push button switch assembly as in claim 1 wherein the at least one mechanism to minimize rotational motion of the switch pad with respect to the decorative plate is at least one tab.

8. The push button switch assembly as in claim 7 wherein the at least one tab is separated from the flange of the push button switch by a gap spacing that is sized to receive the decorative plate therein such that the decorative plate is disposed between the flange and the at least one tab with the at least one tab contacting the interior surface of the decorative plate.

9. The push button switch assembly as in claim 7 wherein the at least one tab has a flexible pivot at a point of connection to said exterior surface of said second end.

10. A push button switch assembly comprising:

a push button switch having a first end and a second end and a longitudinal axis extending therebetween, said first end having a push button pad surrounded by a flange, and said second end having a pair of electrical contacts;

a decorative plate having an exterior surface and an interior surface, an aperture extending through from said exterior surface to said interior surface, said aperture dimensioned to receive said second end of said push button switch therethrough, said exterior surface of said plate having a recess shaped to receive said flange of said first end; and said second end of said push button switch having an exterior surface, said exterior surface of said second end having at least one tab separated from the flange by a gap spacing along the longitudinal axis of the push button switch, the gap spacing being sized to receive the decorative plate therein, the at least one tab being adjacent said interior surface of the decorative plate with the push button switch installed in the decorative plate.

11. The push button switch assembly as in claim 10 wherein said push button pad is substantially square in shape.

12. The push button switch assembly as in claim 10 wherein said push button pad is substantially rectangular in shape.

13. The push button switch assembly as in claim 10 wherein each said electrical contact is a screw contact.

14. The push button switch assembly as in claim 10 wherein said at least one tab has a flexible pivot at a point of connection to said exterior surface of said second end.

15. The push button switch assembly as in claim 10 wherein said second end is substantially cylindrical in shape.

16. A replacement push button switch to fit at least partially into an existing aperture of a decorative plate comprising:

a push button switch having an insert and a flange, said flange having an inside surface and an outside surface, said insert having a first end and a second end, said first end of said insert adjacent said inside surface of said flange, said insert being dimensioned to be received in the aperture of said decorative plate;

said insert having at least one tab adapted to engage an interior surface of said plate, the at least one tab having a flexible pivot at a point of connection to an exterior surface of the insert, the flexible pivot extending along the exterior surface of the insert at least partially between the first and second ends of the insert;

an inclined surface of the at least one tab that extends away from the exterior surface of the insert and is configured to engage the decorative plate when the insert of the push button switch is inserted into the aperture of the decorative plate such that the tab is shifted into a retracted position;

wherein said inside surface of said flange is adjacent to an exterior surface of said decorative plate with the push button switch installed in the decorative plate;

a push pad disposed on said outside surface of said flange; and a pair of electric contacts disposed on said second end of said insert.

17. The replacement push button switch as in claim 16 wherein said insert is substantially cylindrical in shape.

18. The replacement push button switch as in claim 16 wherein each said electrical contact is a screw contact.

19. A push button switch assembly for a doorbell comprising:

a push button switch having a first end with a push button pad, a second end, and a longitudinal axis extending from the first end to the second end, the push button switch including at least one compressible tab having an exterior edge, the at least one compressible tab configured to pivot around a pivot axis generally parallel to the longitudinal axis of the push button switch;

a flange that is generally perpendicular to the longitudinal axis of the push button switch and which flange is held in spaced relation around the push button switch, the flange having an interior face;

a decorative plate generally perpendicular to the longitudinal axis of the push button switch and which decorative plate includes an exterior surface, an interior surface, and an aperture extending through the decorative plate from the exterior surface through the interior surface; and wherein the aperture of the decorative plate is configured to receive at least a portion of the push button switch, the at least one compressible tab pivotally compressing around the pivot axis as the push button switch is inserted into the aperture of the decorative plate and expanding around the pivot axis as the exterior edge of the at least one compressible tab is extended through the aperture of the decorative plate, the exterior surface of the decorative plate frictionally engaging the interior face of the flange, the interior surface of the decorative plate frictionally engaging the exterior edge of the at least one compressible tab after the at least one compressible tab is compressed and released when the push button switch is extended through the aperture in the decorative plate.

20. The push button switch assembly as recited in claim 19 wherein the interior face of the flange and the exterior edge of the at least one compressible tab hold the push button switch from moving along the longitudinal axis of the push button switch relative to the decorative face plate, and the at least one compressible tab frictionally engages the interior face of the decorative plate to resist rotational movement of the push button switch around the longitudinal axis of the push button switch.

21. The push button switch assembly as recited in claim 19 wherein the push button pad of the push button switch is non-round.

22. The push button switch assembly as recited in claim 19 wherein the second end of the push button switch has a generally cylindrical shape.

23. The push button switch assembly as recited in claim 19 wherein the at least one compressible tab is configured to have a compressed configuration when the push button switch is inserted into the aperture in the decorative plate and an expanded configuration when the at least one compressible tab is extended through the aperture in the decorative plate.

* * * * *